US007915993B2

(12) United States Patent
Liu et al.

(10) Patent No.: US 7,915,993 B2
(45) Date of Patent: Mar. 29, 2011

(54) INDUCTOR

(75) Inventors: Chun-Tiao Liu, Hsinchu (TW); Gwo-Tswin Wu, Nantou County (TW); Roger Hsieh, Hsinchu County (TW); Wen-Hsiung Liao, Hsinchu County (TW)

(73) Assignee: Cyntec Co., Ltd., Science Park, Hsin-Chu (TW)

( * ) Notice: Subject to any disclaimer, the term of this patent is extended or adjusted under 35 U.S.C. 154(b) by 0 days.

(21) Appl. No.: 12/683,448

(22) Filed: Jan. 7, 2010

(65) Prior Publication Data

US 2010/0102917 A1 Apr. 29, 2010

Related U.S. Application Data

(63) Continuation-in-part of application No. 11/156,361, filed on Jun. 20, 2005, now Pat. No. 7,667,565, which is a continuation-in-part of application No. 10/937,465, filed on Sep. 8, 2004, now Pat. No. 7,339,451.

(51) Int. Cl.
*H01F 5/00* (2006.01)

(52) U.S. Cl. ..... 336/200

(58) Field of Classification Search ..... 336/65, 336/83, 178, 200, 210, 212, 220–223
See application file for complete search history.

(56) References Cited

U.S. PATENT DOCUMENTS

| | | | | |
|---|---|---|---|---|
| 4,020,222 | A | 4/1977 | Kausche | |
| 4,063,211 | A | 12/1977 | Yasujima | |
| 5,476,728 | A | 12/1995 | Nakano | |
| 6,104,272 | A | 8/2000 | Yamamoto | |
| 6,181,232 | B1 | 1/2001 | Kitamura | |
| 6,314,637 | B1 | 11/2001 | Kimura | |
| 6,356,179 | B1 * | 3/2002 | Yamada | 336/175 |
| 6,621,397 | B2 | 9/2003 | Hsu | |
| 7,034,645 | B2 | 4/2006 | Shafer | |
| 7,280,025 | B2 * | 10/2007 | Sano | 336/200 |
| 7,772,955 | B1 * | 8/2010 | Li et al. | 336/200 |
| 2002/0074991 | A1 | 6/2002 | Clausse | |
| 2003/0035937 | A1 | 2/2003 | Petkie | |
| 2004/0209120 | A1 | 10/2004 | Inoue | |

(Continued)

FOREIGN PATENT DOCUMENTS

| | | |
|---|---|---|
| CN | 2111527 | 7/1992 |

(Continued)

OTHER PUBLICATIONS

Werner Hugo Wolfle and William Gerard Hurley, Quasi-Active Power Factor Correction With a Variable Inductive Filter: Theory, Design and Practice, IEEE Transactions on Power Electronics, Jan. 2003, pp. 248-255, vol. 18, No. 1.

*Primary Examiner* — Tuyen Nguyen
(74) *Attorney, Agent, or Firm* — Winston Hsu; Scott Margo

(57) ABSTRACT

An inductor includes a first core, a second core, a protruding structure, at least two gaps and a conducting wire. The first core has a protruding portion. The second core is disposed opposite to the first core. The protruding structure protrudes from the protruding portion of the first core and toward the second core. The at least two gaps are between the protruding portion of the first core and the second core. The conducting wire winds around at least one of the first and second cores. The conducting wire has a specific resistance value of 1.42 μΩm or lower.

20 Claims, 12 Drawing Sheets

U.S. PATENT DOCUMENTS

| | | | | |
|---|---|---|---|---|
| 2005/0258930 | A1 | 11/2005 | Ishida | |
| 2007/0252669 | A1* | 11/2007 | Hansen et al. | 336/212 |
| 2009/0066454 | A1* | 3/2009 | Hansen | 336/83 |

FOREIGN PATENT DOCUMENTS

| | | | |
|---|---|---|---|
| CN | 1490824 | | 4/2004 |
| JP | 08031673 | A | 2/1996 |
| JP | 2000232028 | | 8/2000 |
| JP | 2001196541 | | 7/2001 |
| JP | 2002228688 | | 8/2002 |
| JP | 2004115311 | | 4/2004 |
| TW | 366421 | | 8/1999 |
| TW | 501150 | | 9/2002 |
| TW | 503408 | | 9/2002 |

* cited by examiner

INDUCTOR

CROSS REFERENCE TO RELATED APPLICATIONS

This application is a Continuation in Part application of application Ser. No. 11/156,361, filed on Jun. 20, 2005, which is a Continuation in Part application of application Ser. No. 10/937,465, filed on Sep. 8, 2004. This application has a reference to application Ser. No. 11/156,361 and application Ser. No. 10/937,465, and application Ser. No. 11/156,361 has a reference to application Ser. No. 10/937,465.

BACKGROUND OF THE INVENTION

1. Field of the Invention

The invention relates to an inductor and, more particularly, to an inductor with at least two different reductions in inductance.

2. Description of the Prior Art

An inductor is a passive electrical component that can store energy in a magnetic field created by the electric current passing through it. An inductor's ability to store magnetic energy is measured by its inductance. Typically an inductor is a conducting wire shaped as a coil, the loops helping to create a strong magnetic field inside the coil due to Faraday's Law of Induction. Inductance is an effect resulting from the magnetic field that forms around a current-carrying conductor which tends to resist changes in the current. The number of loops, the size of each loop, and the material it is wrapped around all affect the inductance. For example, the magnetic flux linking these turns can be increased by coiling the conductor around a material with a high permeability such as ferrite magnet.

In electromagnetism, permeability is the degree of magnetization that a material obtains in response to an applied magnetic field. The permeability of a magnetic material is the ability of the material to increase the flux intensity or flux density within the material when electric current flows through a conductor wrapped around the magnetic materials providing the magnetization force. In general, when electric current flows through a conventional inductor, only one permeability can be obtained. Therefore, the usage of the conventional inductor is limited.

Furthermore, for those of ordinary skill in the art, an inductive coil is usually not suitable for current measurement due to the variation of resistance with temperature. Specifically, an inductive coil is generally made with copper coils. Since the copper has a relative high temperature coefficient of resistance (TCR), as the current passes through the copper coils, the coils experience a temperature rise. A higher temperature in turn causes a higher resistance in the coils with a positive TCR. The variation of the resistance in turn causes a change in the current conducted in the coils. For these reasons, in order to measure a direct current conducted in the coils, a separate resistor that is serially connected to the coils is often required.

Therefore, a need still exists in the art of design to provide a novel and improved inductor with at least two different reductions in inductance. In order simplify the implementation configuration with reduced cost; it is desirable to first eliminate the requirement of using a separate resistor for current measurement. It is desirable that the improved inductor configuration can be simplified to achieve lower production costs, high production yield while capable of providing inductor that more compact with lower profile such that the inductor can be conveniently integrated into miniaturized electronic devices. It is further desirable the new and improved inductor can improve the production yield with simplified configuration.

SUMMARY OF THE INVENTION

An objective of the invention is to provide an inductor with at least two different reductions in inductance.

Another objective of the invention is to provide a new inductive coil composed of alloys of low TCR such as Cu—Mn—Ni, Cu—Ni, Ni—Cr, and Fe—Cr alloys such that a high degree of current measurement accuracy can be maintained. With low value TCR the error of current measurement due to temperature variations are maintained at a very low level without requiring using a separate resistor.

According to one embodiment, an inductor of the invention comprises a first core, a second core, a protruding structure, at least two gaps and a conducting wire. The first core has a protruding portion. The second core is disposed opposite to the first core. The protruding structure protrudes from the protruding portion of the first core and toward the second core. The at least two gaps are between the protruding portion of the first core and the second core. The conducting wire winds around at least one of the first and second cores. The conducting wire is composed of a metallic alloy having temperature coefficients of resistance (TCR) 700 ppm/° C. or lower, wherein the conducting wire has a specific resistance value of 1.42 μΩm or lower. When electric current flows through the conducting wire, magnetic flux varies at the at least two gaps so as to generate at least two different reductions in inductance.

According to another embodiment, an inductor of the invention comprises a first core, a second core, at least one protruding structure, at least two gaps and a conducting wire. The first core has a protruding portion. The second core is disposed opposite to the first core. The at least one protruding structure protrudes from the protruding portion of the first core and toward the second core. The at least two gaps are between the protruding portion of the first core and the second core. The conducting wire winds around at least one of the first and second cores. The conducting wire has a specific resistance value of 1.42 μΩm or lower. When electric current flows through the conducting wire, magnetic flux varies at the at least two gaps so as to generate at least two different reductions in inductance.

According to another embodiment, an inductor of the invention comprises a first core, a second core, at least two gaps and a conducting wire. The first core has a protruding portion. The second core is disposed opposite to the first core. The at least two gaps are between the protruding portion of the first core and the second core. The conducting wire winds around at least one of the first and second cores. The conducting wire has a specific resistance value of 1.42 μΩm or lower. When electric current flows through the conducting wire, magnetic flux varies at the at least two gaps so as to generate at least two different reductions in inductance.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
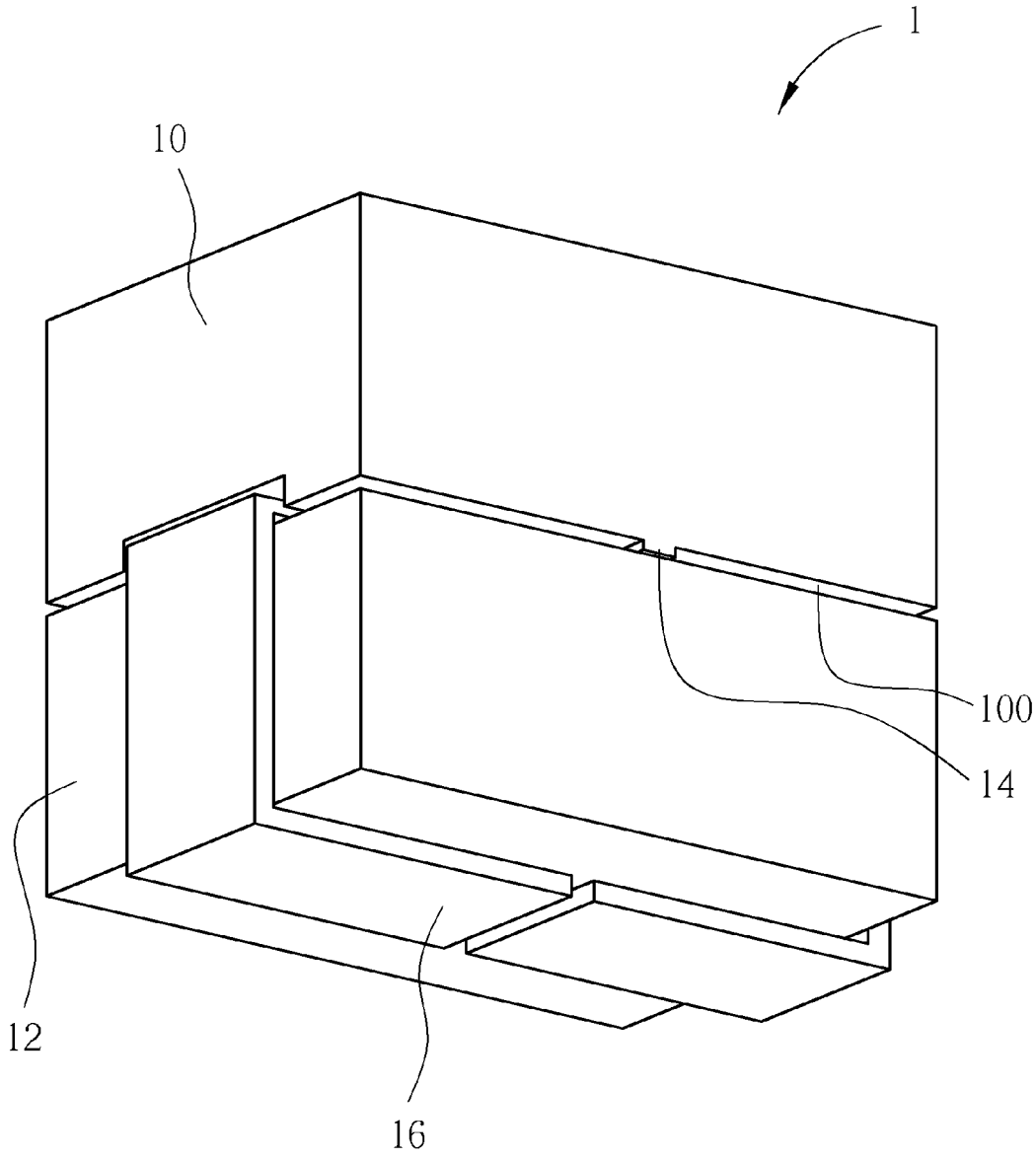
FIG. 1 is a perspective illustrating an inductor according to one embodiment of the invention.
Figure 2:
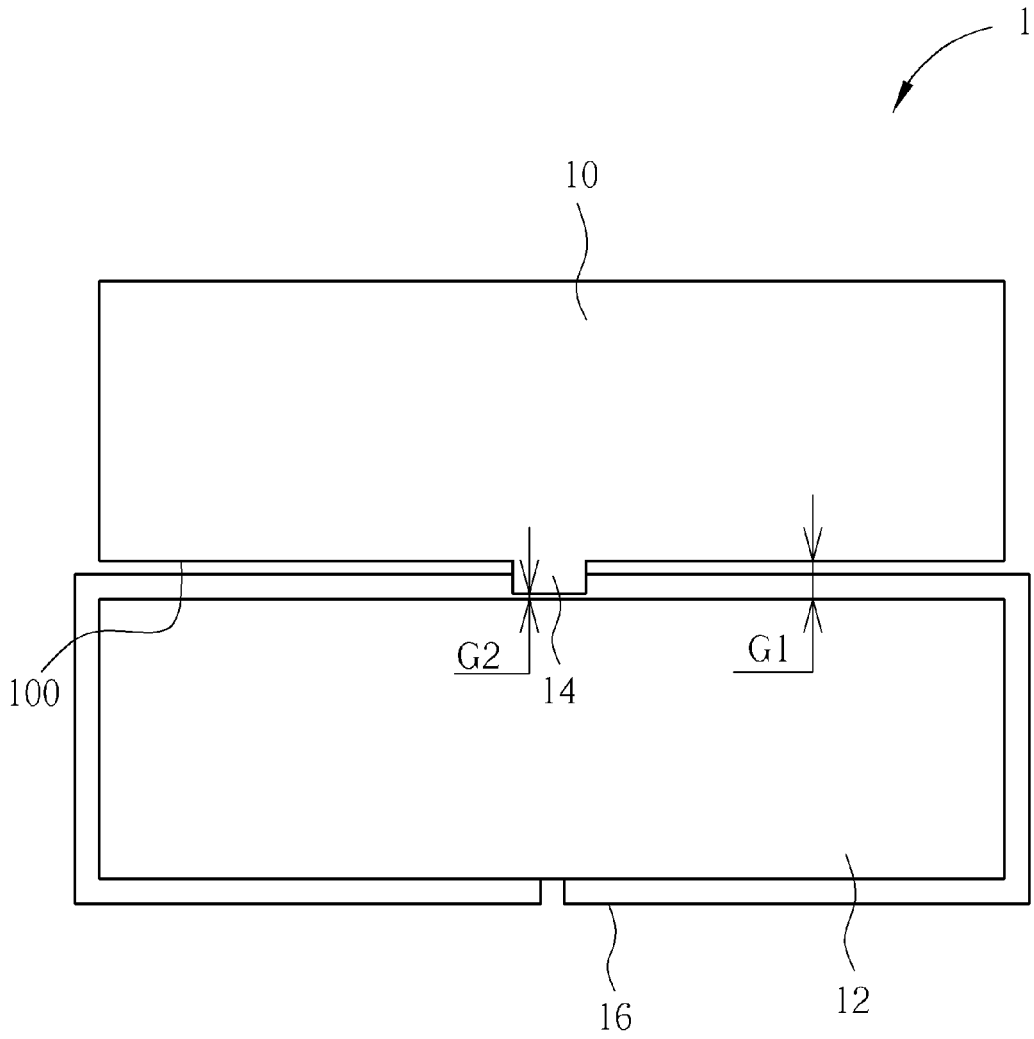
FIG. 2 is a side view illustrating the inductor shown in FIG. 1.
Figure 3:
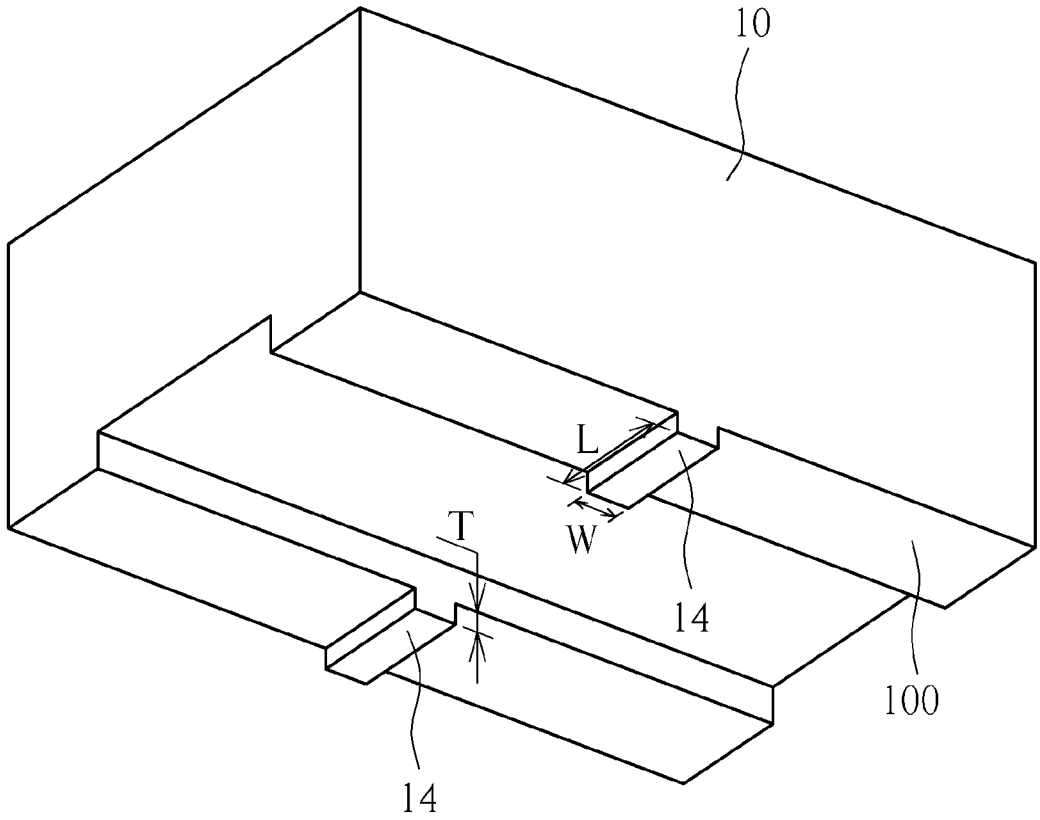
FIG. 3 is a perspective view illustrating the first core shown in FIG. 1.

Referring to FIGS. 1 to 3, FIG. 1 is a perspective illustrating an inductor 1 according to one embodiment of the invention, FIG. 2 is a side view illustrating the inductor 1 shown in FIG. 1, and FIG. 3 is a perspective view illustrating the first core 10 shown in FIG. 1. As shown in FIGS. 1 and 2, the inductor 1 comprises a first core 10, a second core 12, a protruding structure 14 and a conducting wire 16. The first core has a protruding portion 100. The second core 12 is disposed opposite to the first core 10. The protruding structure 14 protrudes from the protruding portion 100 of the first core 10 and toward the second core 12. In this embodiment, a volume of the protruding structure 14 is smaller than or equal to three percent of the first core. The protruding portion 100 is located at one side of the first core 10, there is a first gap G1 between the protruding portion 100 of the first core 10 and the second core 12, and there is a second gap G2 between the protruding structure 14 and the second core 12. The conducting wire 16 passes through the hollow of the first core 10 and winds around the second core 12. It should be noted that, in another embodiment, the conducting wire 16 can also wind around the first core 10, and it depends upon practical applications.

As shown in FIG. 3, there are two longitudinal protruding structures 14 protruding from opposite sides of the first core 10. In this embodiment, the first core 10 and the protruding structures 14 are formed integrally. A material of the first core 10, the second core 12 or the protruding structure 14 can be iron powder, ferrite, permanent magnet or other magnetic materials. Since the first core 10 and the protruding structures 14 are formed integrally, the material of the first core 10 is the same as that of the protruding structures 14. However, in another embodiment, the protruding structures 14 can be individual components attached on the first core 10, and it depends upon practical applications. If the protruding structures 14 are individual components, the material of the protruding structures 14 may be the same as or different from the first core 10. Furthermore, the first gap G1 can be an air gap, a magnetic gap or a non-magnetic gap, the second gap G2 can be also an air gap, a magnetic gap or a non-magnetic gap, and it depends upon practical applications.

In this embodiment, the first core 10 has a first permeability $\mu 1$, the second core 12 has a second permeability $\mu 2$, the first gap G1 has a third permeability $\mu 3$, the second gap G2 has a fourth permeability $\mu 4$, each of the protruding structures 14 has a fifth permeability $\mu 5$, and there is a relation between the first through fifth permeabilities as follows, $\mu 1 \geqq \mu 2 \geqq \mu 5 \geqq \mu 4 \geqq \mu 3$. For example, if the materials of the first core 10, the second core 12 and the protruding structures 14 are the same, and the first gap G1 and the second gap G2 are the same, the relation between the first through fifth permeabilities will be $\mu 1 = \mu 2 = \mu 5 > \mu 4 = \mu 3$.

Figure 4:
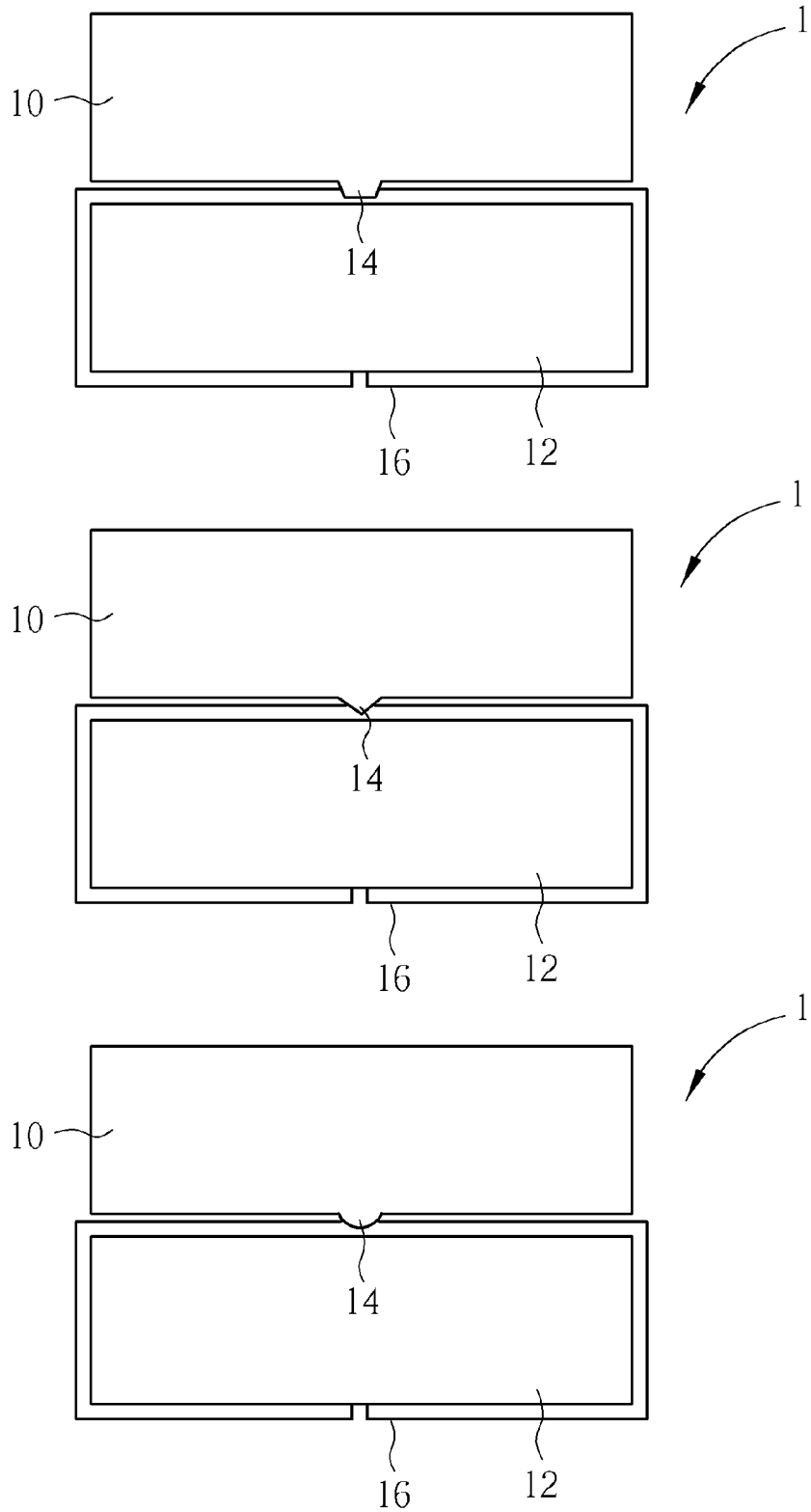
FIG. 4 illustrates three types of the protruding structure in different shapes.

As shown in FIGS. 2 and 3, in this embodiment, a shape of the protruding structure 14 is rectangle, and a major axis of the protruding structure 14 is perpendicular to that of the protruding portion 100. However, referring to FIG. 4, FIG. 4 illustrates three types of the protruding structure 14 indifferent shapes. In another embodiment, the shape of the protruding structure 14 can be also trapezoid, taper or arc, as shown in FIG. 4. In other words, the shape of the protruding structure 14 can be designed based on practical applications.

In this embodiment, the first gap G1 may be larger than or equal to 0.01 mm and lower than or equal to 0.3 mm, and the second gap G2 may be lower than or equal to 0.15 mm. Furthermore, as shown in FIG. 3, the protruding structure 14 has a length L, a width W and a thickness T. The length L will affect an initial inductance of the inductor 1, and the thickness T relates to the first gap G1 and the second gap G2. The length L, the width W and the thickness T can be determined based on practical applications. Preferably, the width W of the protruding structure 14 may be lower than or equal to 1.5 mm.

In this embodiment, the conducting wire 16 may be composed of a metallic alloy having temperature coefficients of resistance (TCR) 700 ppm/° C. or lower, wherein the conducting wire 16 has a specific resistance value of 1.42 μΩm or lower. A metallic alloy of low TCR may be Cu—Mn—Ni metallic alloy, Ni—Cr metallic alloy, Cu—Ni metallic alloy, Fe—Cr metallic alloy or the like. The table 1 below shows some examples of metallic alloys with achievable low TCR for each of these metallic alloys.

TABLE 1

| Material system | Specific resistance value (micro ohm-m) | TCR (ppm/deg) |
|---|---|---|
| Cu—Mn—Ni system | 0.44 | ±10 |
| Cu—Ni system | 0.49 | ±20 |
| | 0.3 | 180 |
| | 0.15 | 420 |
| | 0.1 | 650 |
| | 0.43 | 700 |
| Ni—Cr system | 1.08 | 200 |
| | 1.12 | 260 |
| Fe—Cr system | 1.42 | 80 |

Figure 5:
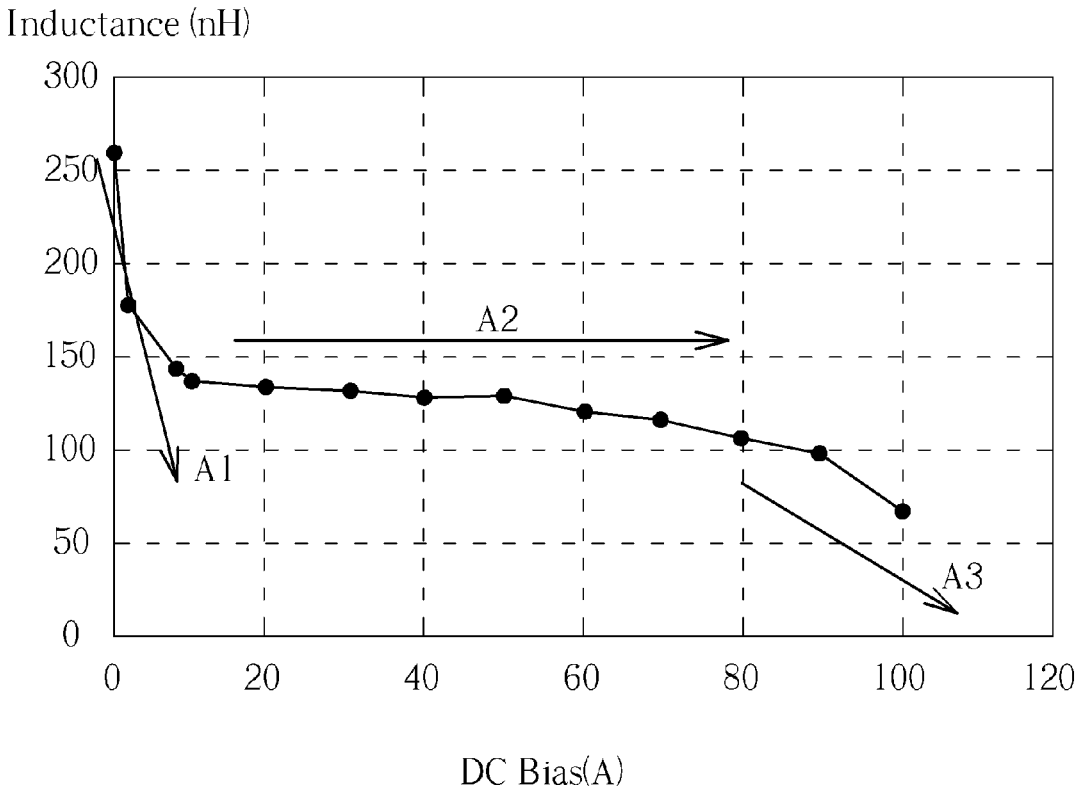
FIG. 5 illustrates a saturation current curve of the inductor shown in FIG. 1.
Figure 6:
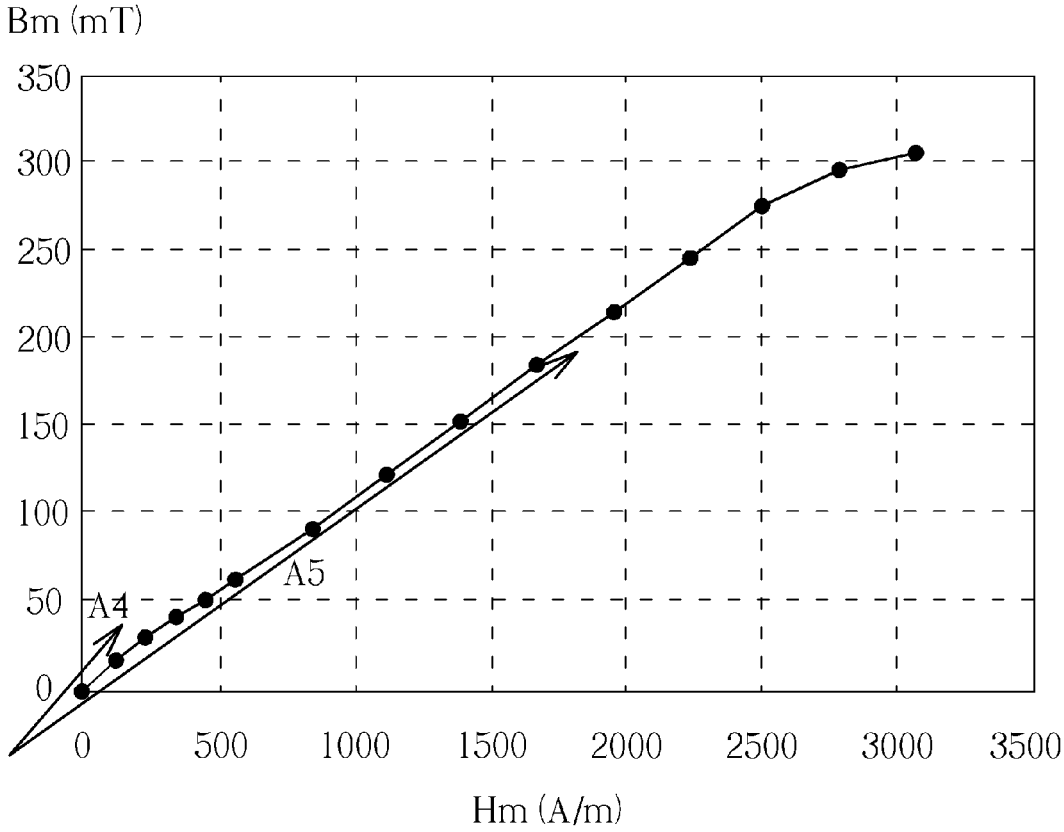
FIG. 6 illustrates a performance of the B-H curve which is the characteristic of the magnetic material of the inductor shown in FIG. 1.

Referring to FIGS. 5 and 6, FIG. 5 illustrates a saturation current curve of the inductor 1 shown in FIG. 1, and FIG. 6 illustrates a performance of the B-H curve which is the characteristic of the magnetic material of the inductor 1 shown in FIG. 1. When electric current flows through the conducting wire 16, magnetic flux varies at the gaps G1 and G2 so as to generate two different reductions in inductance. The invention utilizes the protruding structures 14 to form the second gap G2, so as to generate first inductance dropped indicated by the arrow A1 in FIG. 5. Afterwards, due to saturation flux density of the material and the first gap G1, the state indicated by the arrow A2 in FIG. 5 can be obtained. Finally, second inductance dropped indicated by the arrow A3 in FIG. 5 is achieved. As shown in FIG. 6, when electric current flows through the inductor 1 of the invention, two different permeabilities indicated by the two arrows A4 and A5 can be obtained.

Figure 7:
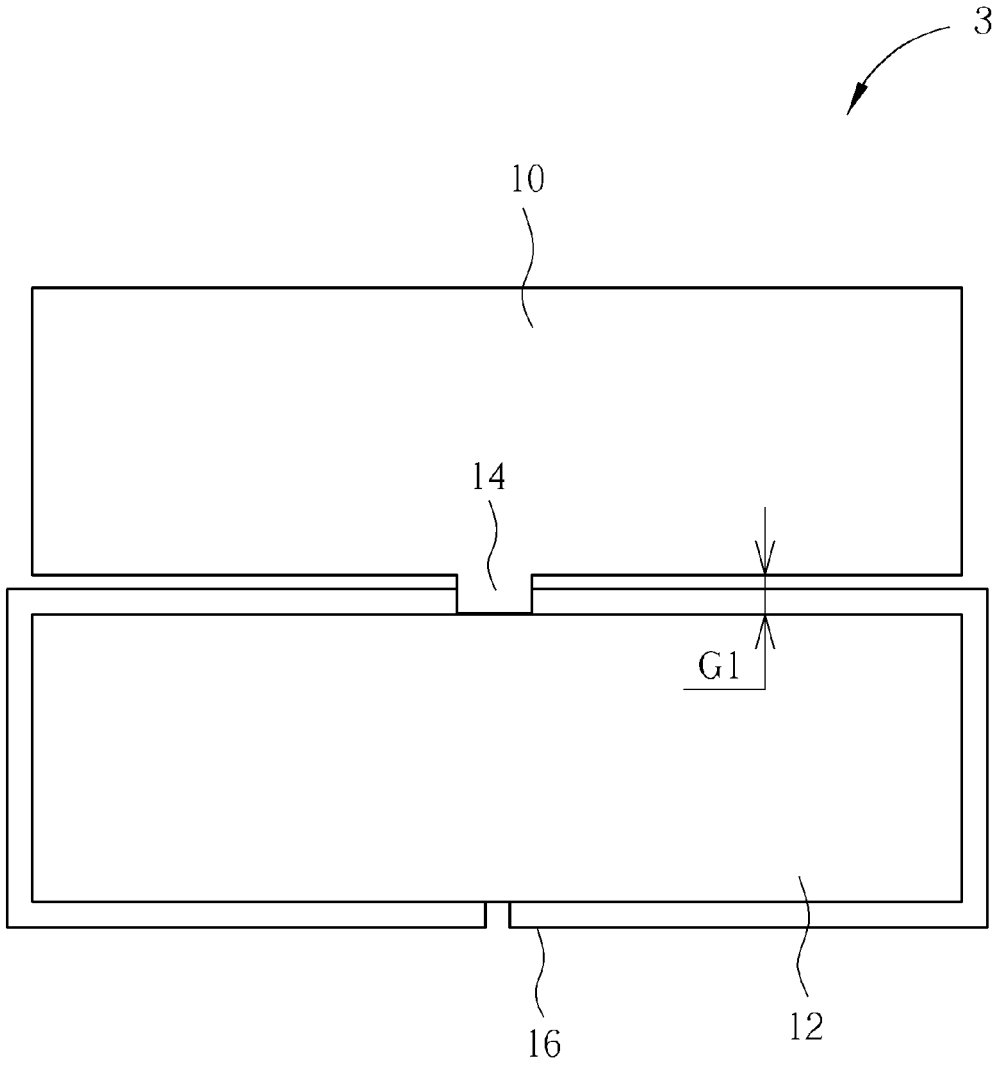
FIG. 7 is a side view illustrating an inductor according to another embodiment of the invention.

Referring to FIG. 7, FIG. 7 is a side view illustrating an inductor 3 according to another embodiment of the invention. As shown in FIG. 3, the main difference between the inductor 3 and the aforesaid inductor 1 is that the protruding structure 14 contacts the second core 12. In other words, in this embodiment, the aforesaid second gap G2 substantially tends to zero.

Figure 8:
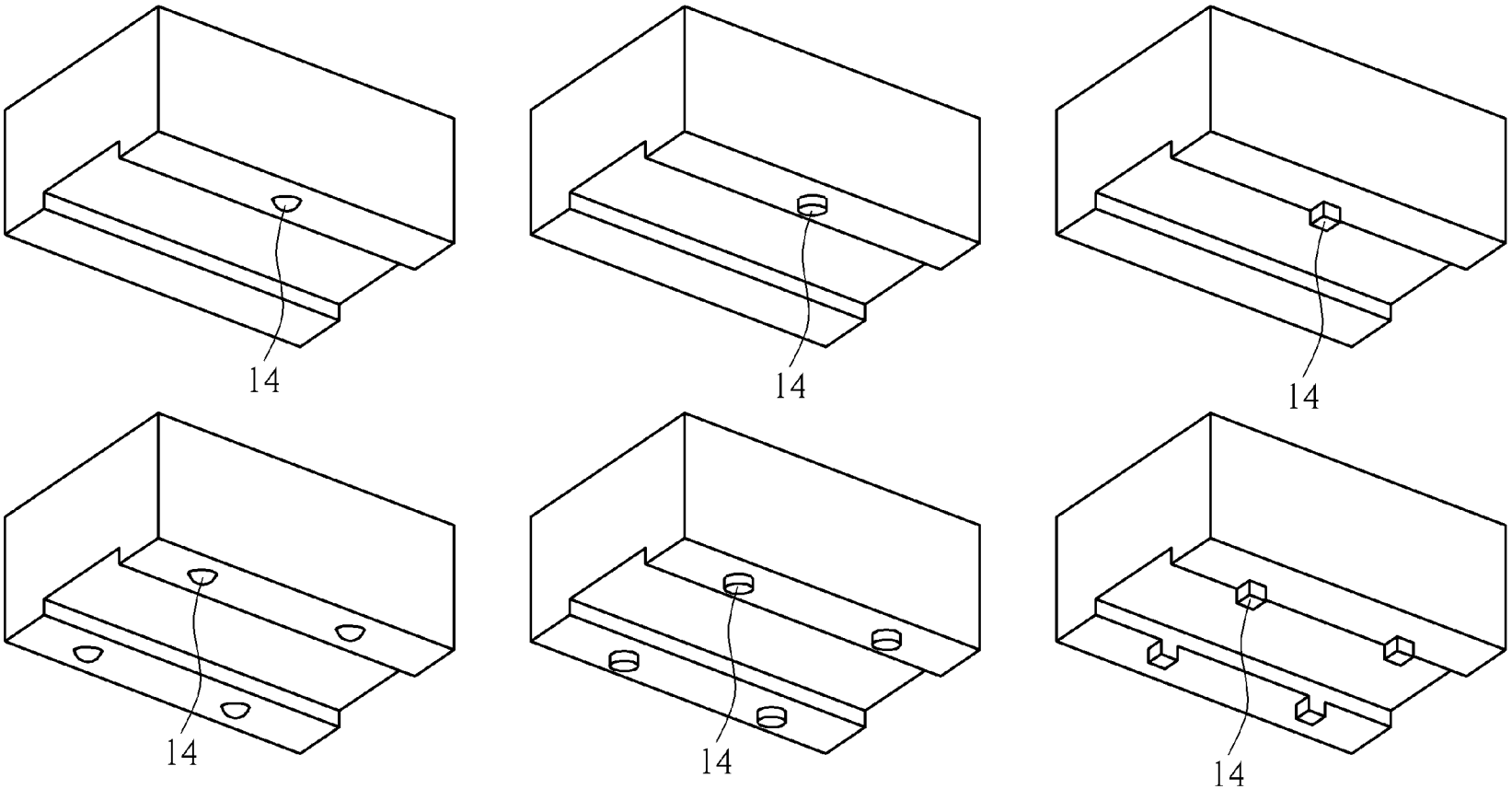
FIG. 8 illustrates some types of the protruding structure in different shapes.

Referring to FIG. 8, FIG. 8 illustrates some types of the protruding structure 14 in different shapes. As shown in FIG. 8, the protruding structure(s) 14 may be single on one side or four on opposite sides symmetrically, and the shape of the protruding structure 14 may be arc, circular or rectangle. Furthermore, the length of the protruding structure 14 shown in FIG. 8 can be shorter than that of the protruding structure 14 shown in FIG. 3. That is to say, the number, arrangement and shape of the protruding structures 14 of the invention do not be limited to the aforesaid description with related figures and can be determined based on practical applications.

Figure 9:
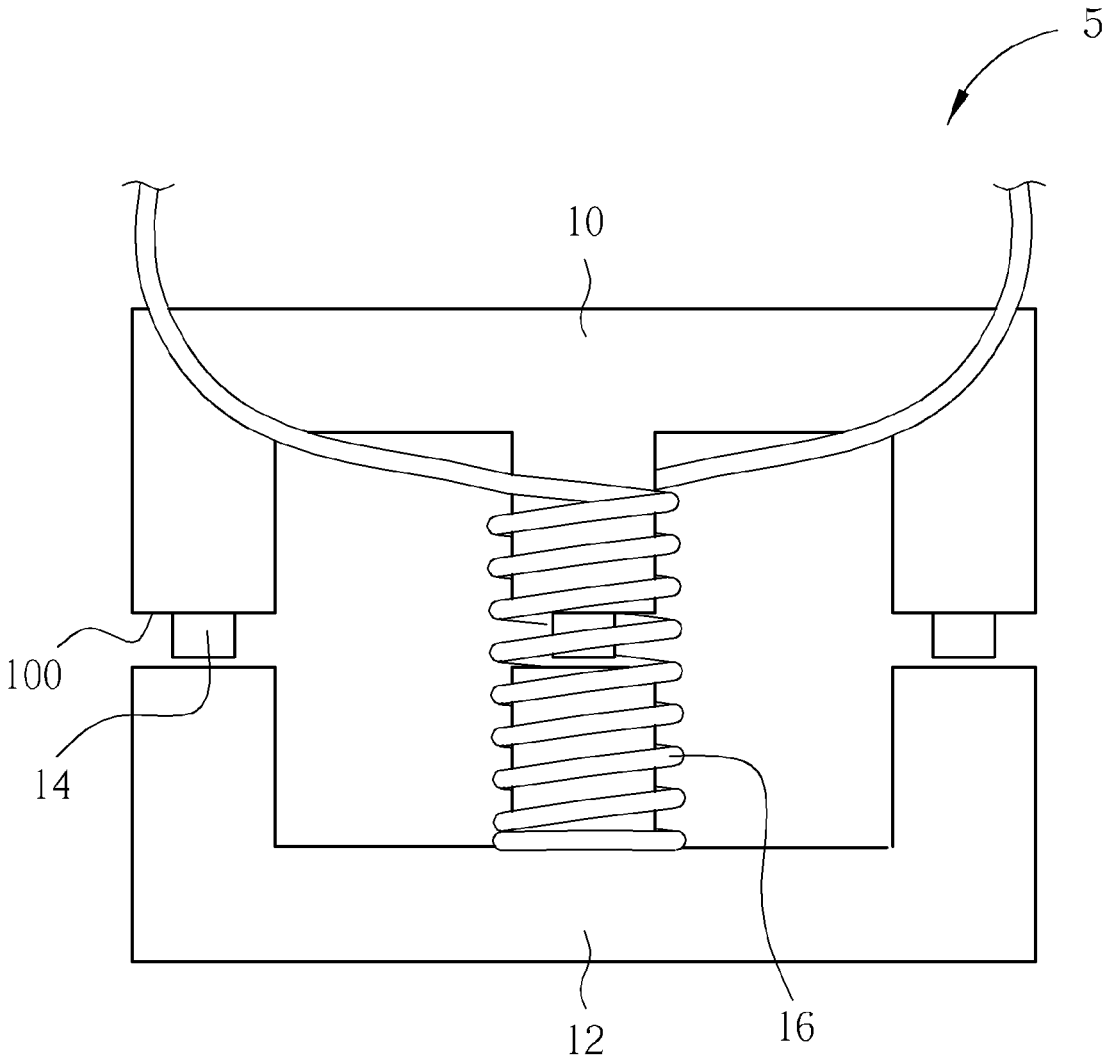
FIG. 9 is a side view illustrating an inductor according to another embodiment of the invention.
Figure 10:
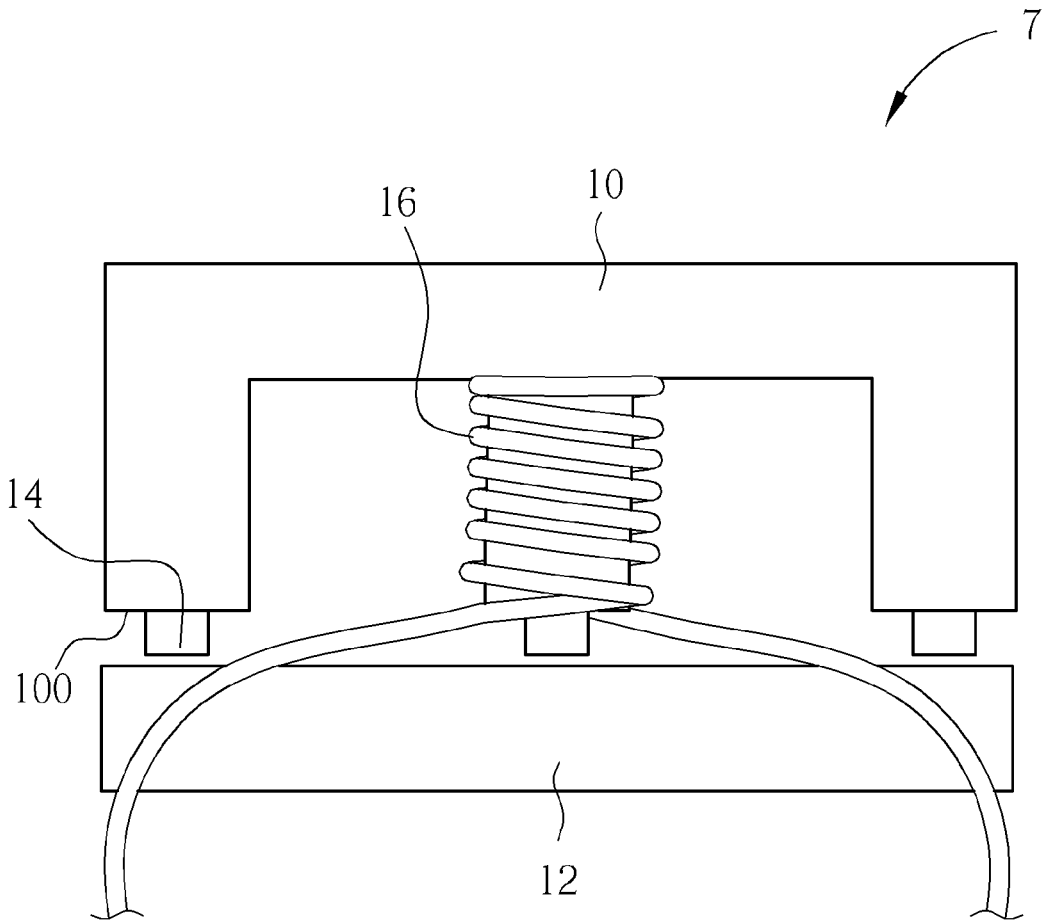
FIG. 10 is a side view illustrating an inductor according to another embodiment of the invention.
Figure 11:
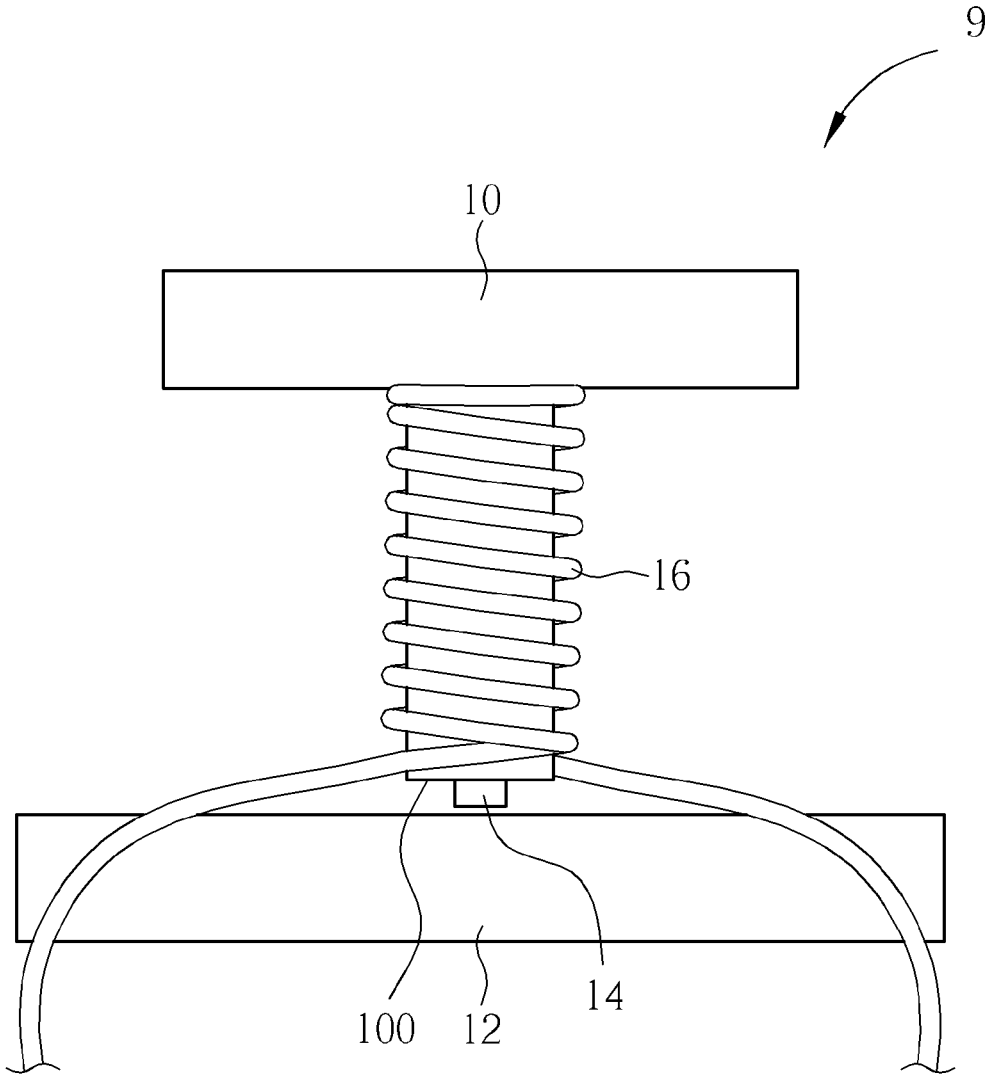
FIG. 11 is a side view illustrating an inductor according to another embodiment of the invention.

Referring to FIGS. 9 to 11, FIG. 9 is a side view illustrating an inductor 5 according to another embodiment of the invention, FIG. 10 is a side view illustrating an inductor 7 according to another embodiment of the invention, and FIG. 11 is a side view illustrating an inductor 9 according to another embodiment of the invention. As shown in FIG. 9, the first and second cores 10 and 12 are EE-shaped. As shown in FIG. 10, the first and second cores 10 and 12 are EI-shaped. As shown in FIG. 11, the first and second cores 10 and 12 are TI-shaped. In other words, the shapes of the first and second cores 10 and 12 of the invention can be also determined based on practical applications.

Figure 12:
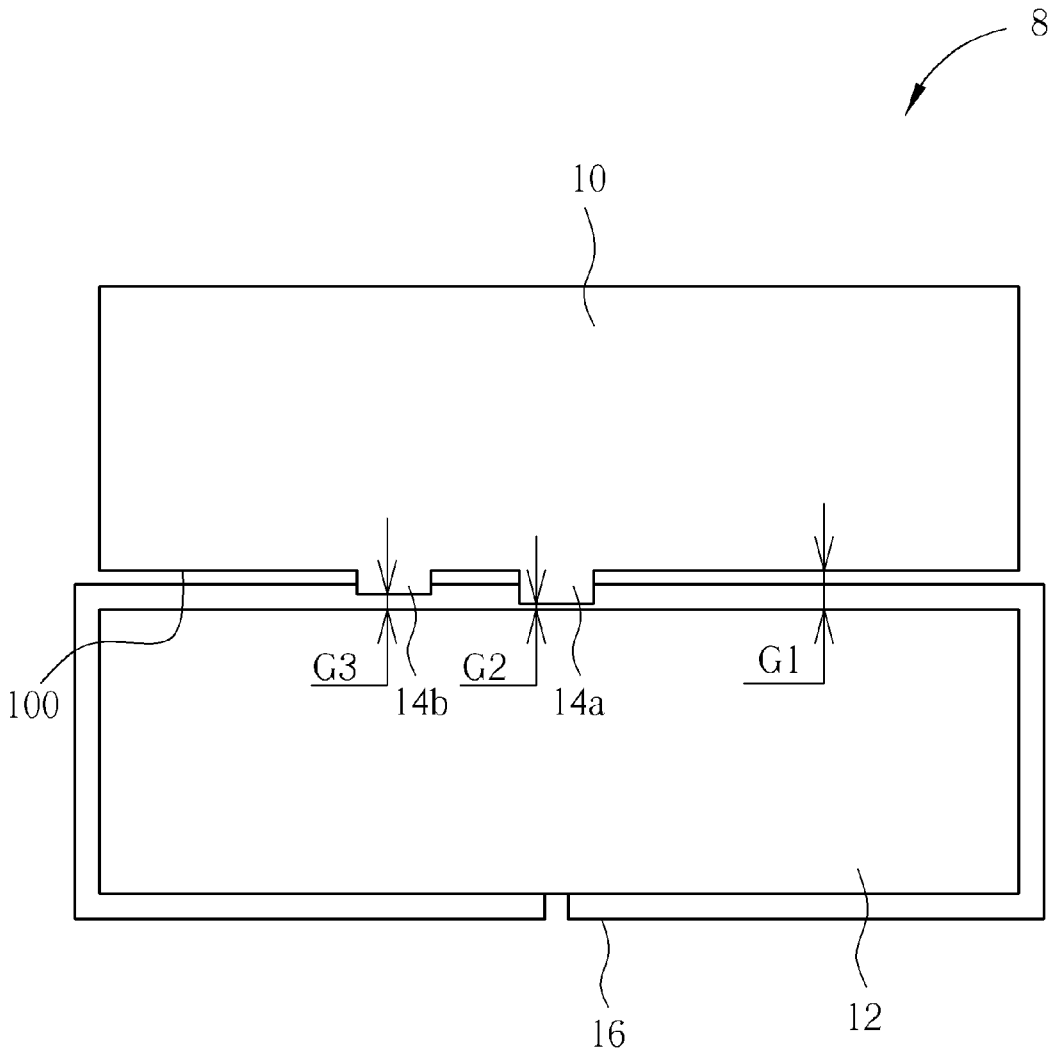
FIG. 12 is a side view illustrating an inductor according to another embodiment of the invention.

Referring to FIG. 12, FIG. 12 is a side view illustrating an inductor 8 according to another embodiment of the invention. As shown in FIG. 12, there are two protruding structures 14*a* and 14*b* protruding from the protruding portion 100 of the first core 10. In this embodiment, there is a first gap G1 between the protruding portion 100 of the first core 10 and the second core 12, there is a second gap G2 between the protruding structure 14*a* and the second core 12, and there is a third gap G3 between the protruding structure 14*b* and the second core 12. As shown in FIG. 12, since the thickness of the protruding structure 14*a* is larger than that of the protruding structure 14*b*, the second gap G2 is smaller than the third gap G3. In other words, if there are at least two protruding structures with different thickness protruding from the protruding portion 100 of the first core 10, there will be at least two different gaps between the protruding structures and the second core 12 correspondingly. The number of protruding structures with different thickness can be determined based on practical applications.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An inductor comprising:

a first core having a protruding portion;

a second core disposed opposite to the first core;

a protruding structure protruding from the protruding portion of the first core and toward the second core;

at least two gaps between the protruding portion of the first core and the second core; and a conducting wire winding around at least one of the first and second cores, the conducting wire being composed of a metallic alloy having temperature coefficients of resistance (TCR) 700 ppm/° C. or lower, wherein the conducting wire has a specific resistance value of 1.42 μΩm or lower.

2. The inductor of claim 1, wherein the at least two gaps comprises a first gap between the protruding portion of the first core and the second core and a second gap between the protruding structure and the second core.

3. The inductor of claim 2, wherein the second gap is lower than or equal to 0.15 mm.

4. The inductor of claim 2, wherein the first core has a first permeability μ1, the second core has a second permeability μ2, the first gap has a third permeability μ3, the second gap has a fourth permeability μ4, the protruding structure has a fifth permeability μ5, and there is a relation between the first through fifth permeabilities as follows, $\mu1 \geqq \mu2 \geqq \mu5 > \mu4 \geqq \mu3$.

5. The inductor of claim 1, wherein the first core and the protruding structure are formed integrally.

6. The inductor of claim 1, wherein a width of the protruding structure is lower than or equal to 1.5 mm.

7. The inductor of claim 1, wherein a volume of the protruding structure is smaller than or equal to three percent of the first core.

8. An inductor comprising:

a first core having a protruding portion;

a second core disposed opposite to the first core;

at least one protruding structure protruding from the protruding portion of the first core and toward the second core;

at least two gaps between the protruding portion of the first core and the second core; and a conducting wire winding around at least one of the first and second cores, wherein the conducting wire has a specific resistance value of 1.42 μΩm or lower.

9. The inductor of claim 8, wherein a shape of the protruding structure is rectangle.

10. An inductor comprising:

a first core having a protruding portion;

a second core disposed opposite to the first core;

at least two gaps between the protruding portion of the first core and the second core;

a conducting wire winding around at least one of the first and second cores, wherein the conducting wire has a specific resistance value of 1.42 μΩm or lower.

11. The inductor of claim 10, wherein the first gap is larger than or equal to 0.01 mm and lower than or equal to 0.3 mm.

12. The inductor of claim 10, wherein the conducting wire is composed of a metallic alloy having temperature coefficients of resistance (TCR) 700 ppm/° C. or lower.

13. The inductor of claim 10, wherein the at least two gaps comprises a first gap between the protruding portion of the first core and the second core and a second gap between a protruding structure, which protrudes from the protruding portion of the first core, and the second core.

14. The inductor of claim 13, wherein the second gap is lower than or equal to 0.15 mm.

15. The inductor of claim 13, wherein the first core has a first permeability μ1, the second core has a second permeability μ2, the first gap has a third permeability μ3, the second gap has a fourth permeability μ4, the protruding structure has a fifth permeability μ5, and there is a relation between the first through fifth permeabilities as follows, $\mu1 \geqq \mu2 \geqq \mu5 > \mu4 \geqq \mu3$.

16. The inductor of claim 13, wherein the first core and the protruding structure are formed integrally.

17. The inductor of claim 13, wherein a width of the protruding structure is lower than or equal to 1.5 mm.

18. The inductor of claim 13, wherein a material of the first core, the second core or the protruding structure is one selected from a group consisting of iron powder, ferrite and permanent magnet.

19. The inductor of claim 13, wherein a volume of the protruding structure is smaller than or equal to three percent of the first core.

20. The inductor of claim 10, wherein the conducting wire is composed of one selected from a group consisting of Cu—Mn—Ni metallic alloy, Ni—Cr metallic alloy, Cu—Ni metallic alloy and Fe—Cr metallic alloy.

* * * * *